United States Patent [19]

Johnson

[11] Patent Number: 4,730,696

[45] Date of Patent: Mar. 15, 1988

[54] EMERGENCY ESCAPE ROPE APPARATUS

[76] Inventor: Arven Johnson, 6324 NW. Waukomis Dr., Kansas City, Mo. 64151

[21] Appl. No.: 82,383

[22] Filed: Aug. 6, 1987

[51] Int. Cl.[4] ..... A62B 1/02

[52] U.S. Cl. ..... 182/20; 182/3; 182/70; 182/100; 182/190

[58] Field of Search ..... 182/3, 5, 7, 70, 100, 182/190, 20; 188/65.1

[56] References Cited

U.S. PATENT DOCUMENTS

| | | | |
|---|---|---|---|
| 257,781 | 5/1882 | Sullivan . | |
| 266,596 | 10/1882 | Travers . | |
| 290,908 | 12/1883 | Miller et al. . | |
| 293,215 | 2/1884 | Baar et al. . | |
| 319,920 | 6/1885 | Molyneux . | |
| 328,331 | 10/1885 | Montague . | |
| 518,857 | 4/1894 | Pease | 182/70 |
| 598,110 | 2/1898 | Petersen . | |
| 654,415 | 7/1900 | Rinn . | |
| 831,808 | 9/1906 | Thompson . | |
| 1,300,870 | 4/1919 | Plush . | |
| 1,447,182 | 3/1923 | Roberts | 182/100 |
| 1,914,889 | 6/1933 | Lugara . | |
| 2,230,786 | 2/1941 | Sutt . | |
| 2,330,470 | 9/1943 | Calahan | 182/70 |
| 3,419,236 | 12/1968 | Weber | 182/5 |
| 3,477,543 | 11/1969 | Vigluicci | 182/100 |
| 3,664,457 | 5/1972 | York . | |
| 4,079,811 | 3/1978 | Driskell . | |
| 4,127,184 | 11/1978 | Strohmeyer . | |
| 4,161,266 | 7/1979 | Howarth | 182/100 |

FOREIGN PATENT DOCUMENTS

| | | | |
|---|---|---|---|
| 2167954 | 6/1986 | United Kingdom | 182/100 |

*Primary Examiner*—Reinaldo P. Machado
*Attorney, Agent, or Firm*—Litman, McMahon & Brown

[57] ABSTRACT

An emergency escape rope apparatus includes an elongated rope with knots or other protruberances spaced along it and which is arrayed within a container. The container has a plurality of elongated protuberance receiving tubes positioned in it, each tube having a slot extending along its wall and opening at an open end of the tube. In an order from one tube to the next, each tube sequentially receives a selected number of knots with loops of the rope between the knots extending through the slots. Between one tube and the next, an anchor segment of the rope between two sequential knots is stretched taut between the top of the one tube and the bottom of the slot of the next tube to retain the knots within the one tube until the rope secured by the next tube has payed out. The container has a clip in its cap for removably retaining a cap end of the rope for quick access. A base end of the container has a socket and plug arrangement which allows access to a base end of the rope but prevents removal of the base end of the rope from the plug when the plug is in the socket.

23 Claims, 13 Drawing Figures

Fig.6.
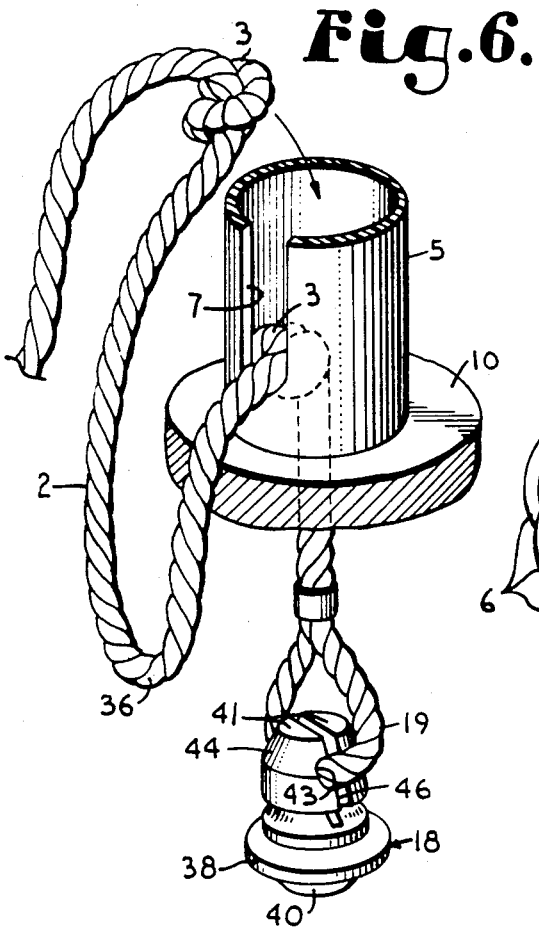
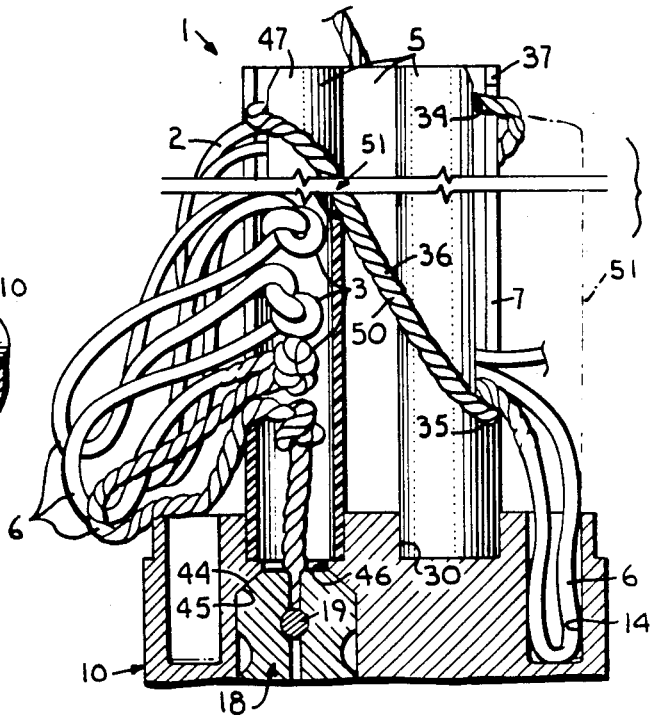
Fig.7.
Fig.8.
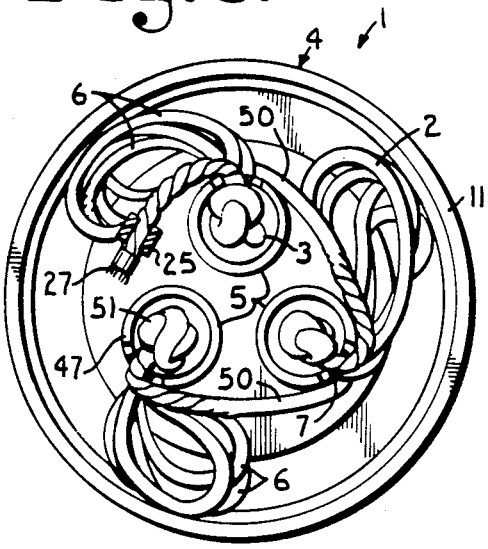
Fig.9.
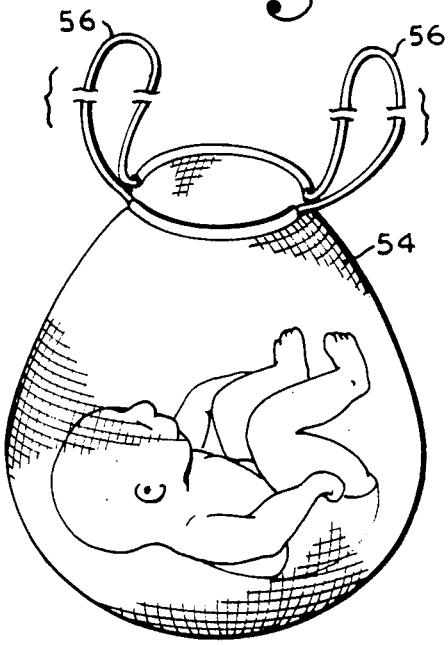

EMERGENCY ESCAPE ROPE APPARATUS

FIELD OF THE INVENTION

The present invention relates to emergency escape devices and, more particularly, to such a device including a knotted rope arranged within a container adapted to provide an orderly, untangled pay out of the rope.

BACKGROUND OF THE INVENTION

When fires occur in multistory buildings, occupants above the ground floor are often faced with the dilemma of jumping from a great height and perishing thereby or staying put and perishing by fire or suffocation. In order to increase the chances of survival of persons in such circumstances, various types of manually deployable escape devices have been developed. Such devices usually take the form of rolled or coiled flexible ladders or ropes.

The flexible ladder escape devices are usually formed of rope or metal chain sides and rigid steps. The flexible ladders are kept rolled or packed and, when their use is required, attached to a substantial structure and unfurled. Flexible ladders have the advantage that they are usually easier to descend by those unskilled and unathletic. However, flexible ladders are bulkier and heavier per unit of length such that there is a limitation to the usuable length of such ladders which can be lifted and thrown out a window by an average person. Some types of flexible ladders are intended for fixed attachment to an external surface of a building wall near a window in a packed condition, with deployment occurring when needed. However, such an arrangement is exposed to weather and may be deteriorated thereby. Additionally, a situation might occur in which a fire blocks the occupants' access to such a fixed attachment location.

Rope type escape devices usually include an elongated rope with knots, large beads, or other protuberances spaced therealong. Some rope devices include an attachment device such as a hook at one end. Protuberances along the rope are not favored by those experienced in rope climbing. However, because ropes are more difficult to use by the unskilled, protuberances are usually included to facilitate maintenance of a grip by such persons. Rope type escape devices are generally lighter per unit of length and more compact than ladder type devices. For this reason, rope devices can usually be longer than ladder type devices. However, there is a practical limit to the length of rope type escape devices. Persons unpracticed at rope climbing and descending usually become fatigued quickly even when coordinating their hands and feet for gripping. Fear of a fire and heights combined with possible smoke inhalation and heat stress are factors which can quicken the onset of fatigue and loss of gripping strength.

Additional rope type escape devices are known including those used in rappelling and those employing rope brakes and harnesses such as are used by professional rescuers and by some types of workers such as window washers of high rise buildings. Such devices require training and agility for safe and effective use and are generally not appropriate for use by those untrained.

One common problem with many such devices is a tendency to become entangled during deployment. This is particularly a problem if the escape device is arrayed within a container. When the container is dropped from an upper floor, if it should strike a structure during descent, there is the possibility of the rope or other escape device being jarred loose within the container with ensuing entanglement. Other entanglement hazards include bouncing of the container such that portions of the rope which have already been payed out of the container become self-entangled or tangled with building structure. Thus, orderly and reliable payout of such escape devices is a continuing problem which has not been solved in the prior art in a compact and economical escape device.

SUMMARY OF THE INVENTION

The present invention provides an emergency escape rope apparatus which overcomes the problems of many prior devices of this type, particularly, the problem of entanglement upon deployment. The escape apparatus according to the present invention includes an elongated rope with protuberances, such as knots, spaced therealong. The knotted rope is arrayed within a container in such a manner that an orderly, untangled deployment of the rope is accomplished.

The preferred container is cylindrical or prismatic and has a plurality of knot receiving tubes positioned therein. Each tube has a slot running therealong to an open end of the tube. The knots are sequentially positioned within the tubes and from tube to tube. The distance from the closed bottom end of the slot of one tube to the open end of the slot of the next tube in the order of tubes is equal to the length of rope between two sequential knots. By this means, an anchor segment of the rope extending from the bottom of the slot of one tube to the top of the slot of the next tube is in a taut condition to thereby exert a force on the stack of knots in the next tube to prevent the knots in it from exiting until those in the first tube have been payed out.

The escape apparatus includes means for quickly accessing the ends of the rope. In a cap of the container, an integral clip is provided in which a cap end of the rope is removably placed. In the base end of the container, a socket is formed which receives a base plug. The base plug includes clamp fingers which loosely grip a base end of the rope when the plug is removed from the base socket. A conical surface is formed on an end of the plug, and a mating surface is formed at an inner end of the socket. When the plug is placed in the socket, engagement between the mating surfaces prevents the separation of the clamp fingers and, by this means, prevents the base end of the rope from being removed from the base plug when the plug is in the socket.

The present invention includes an undrawn drawstring net stored in the container and useful for quickly securing about a small child or pet for their rescue. The drawstrings are then drawn and may be tied over the shoulder of an adult capable of descending the rope or may be tied to the end of the rope and let down by hand. The container may be provided with a foot structure to place the container in an upright orientation, and the cap of the container may be adapted to receive the base of a lamp such that the container forms a pedestal structure for unobtrusive storage of the emergency escape apparatus at a handy location.

OBJECTS OF THE INVENTION

The principal objects of the present invention are: to provide an improved emergency escape apparatus to facilitate escape from an upper floor of a multistory building; to provide such an apparatus including an elongated rope with knots or other protuberances spaced therealong; to provide such an apparatus wherein the knotted rope is arrayed in a container in such a manner that when use of the apparatus is necessary, an end of the rope is tied to a substantial structure, the container is dropped to the ground, and the rope pays out in an orderly and untangled manner; to provide such an apparatus wherein the container has a plurality of slotted knot receiving tubes in which the knots are sequentially received; to provide such an apparatus wherein the length of the slot and the spacing of the tubes in the container are such that an anchor segment of rope extends tautly from the bottom of one tube to the top of the next tube to thereby retain the stack of knots in the next tube in place until the knots in the first tube have payed out; to provide such an apparatus wherein each of a cap and a base of the container includes means for quickly accessing the respective end of the rope; to provide such an apparatus including a removable base plug which tightly clamps a base end of the rope when the plug is positioned in the base and from which the base end of the rope can be easily removed when the plug is removed from the base; to provide such an apparatus including a net with a drawstring which is stored in the container in an undrawn contition and which is useful for enclosing a small child or pet for rescue thereof in cooperation with the rope; to provide such an apparatus wherein the container is adapted for use as a lamp pedestal structure for unobtrusive and handy storage of the rescue apparatus until use is necessary; and to provide such an apparatus which is economical to manufacture, durable in storage and use, safe and effective in use, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 6 is a further enlarged fragmentary perspective view showing cooperation between a knot receiving tube and a knotted rope of the escape apparatus.

FIG. 7 is a fragmentary view similar to FIG. 2 and illustrates portions of the container with the knotted rope arrayed therein.

FIG. 8 is a top plan view of the container with the knotted rope arrayed therein in cooperation with the knot receiving tubes.

FIG. 9 is a diagrammatic perspective view of a drawstring net shown enclosed about a figure representing a small child or a pet.

DETAILED DESCRIPTION OF THE INVENTION

Figure 1:
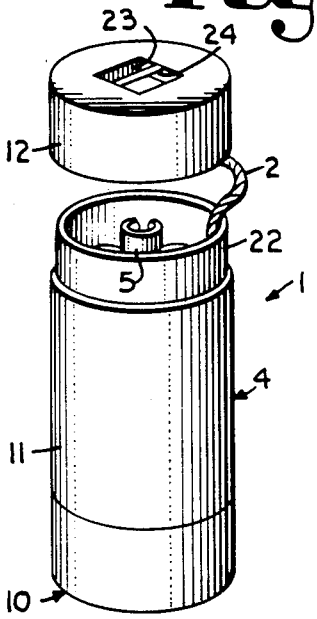
FIG. 1 is a perspective view of a container enclosing the emergency escape rope apparatus according to the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates an emergency escape rope apparatus according to the present invention. The apparatus 1 generally comprises an elongated flexible line or rope 2 with protuberances or knots 3 spaced therealong which is arrayed or packed within a container 4 having slotted tubes 5 positioned therein. The rope 2 is packed within the container 4 by sequentially sliding the knots 3 into the tubes 5 with loops 6 of the rope between the knots 3 extending out of the tubes 5 through slots 7 formed along the tubes 5. In this manner, the rope 2 may be sequentially payed out of the container 4 in an orderly and untangled manner.

The preferred container 4 is cylindrical in form and includes a base 10, a side wall portion 11, and a cap 12. The base 10 is roughly disc shaped and is adapted to have the tubes 5 attached as by pressing same into the base 10. Three such tubes 5 are illustrated; however, more or fewer may be employed depending upon the length of rope 2 required to be stored and the desired length of the container 4. An annular space 14 is formed in an upper surface 15 of the base 10 for storage of the lower loops 6 of the rope 2, as is illustrated in FIG. 7. A socket 16 is formed in a lower surface 17 of the base 10 to receive a base plug 18 to which is attached a base end 19 of the rope 2. An upper rim of the base 10 is reduced in radius to form a neck 20 to slidably receive the container side wall 11 thereon. It is desirable that the side wall 11 fit snugly onto the base 10 since the side wall 11 aids in the orderly pay out of the rope 2 during use of the apparatus 1.

The container side wall 11 is cylindrical and tubular and is sized to fit the neck 20 of the base 10. Preferably, the side wall 11 is separable from the base 10 to facilitate repacking the rope 2 therein, as after a practice use. The side wall 11 has a neck area 22 formed at one end thereof to slidably receive the cap 12 thereon. Preferably, the base 10, side wall 11, and cap 12 are formed of a light, durable, and somewhat compliant material, such as a plastic like polyvinyl chloride, to avoid fracture or other impact damage when the container 4 is dropped from a substantial height.

The illustrated cap 12 has an external recess 23 formed therein, and a cap handle 24 extends across the recess 23 for gripping to facilitate removal of the cap 12 from the side wall 11. A clip 25 is provided on an inner surface 26 of the cap to receive a cap end 27 of the rope 2. When the rope 2 is packed into the container 4, the cap end 27 is secured in the clip 25 such that the end 27 is easily accessed when the cap 12 is removed from the container 4. It is desirable for the cap end 27 of the rope to be quickly accessible during use of the apparatus 1 so that it may be tied to a structure without delay and the apparatus 1 dropped to the ground to provide an escape.

In the apparatus 1, the slotted tubes 5 provide a means of packing the rope 2 for orderly payout without tangling. Tubes, as such, are not essential to an apparatus according to the present invention. It is the slots 7 and the manner of packing the rope 2 therein which allows sequential payout of the knotted rope 2. The tubes 5 are a convenient structure for providing the necessary slots 7. Alternatively, other types of structures having slots and knot or protuberance receiving spaces could be employed without departing from the spirit of the present invention.

Figure 4:
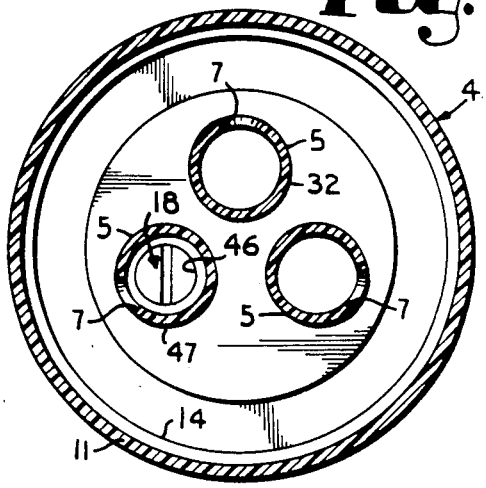
FIG. 4 is a transverse sectional view taken along line 4—4 of FIG. 2 and illustrates details of the knot receiving tubes of the container.

The illustrated tubes 5 have a diameter to loosely receive the knots or protuberances 3 therein and a length depending on the length of the rope 2 and the number of tubes 5 which will be employed. The tubes 5 are set into bores 30 through the upper surface 15 of the container base 10. It is desirable that the tubes 5 stay in place during deployment of the rope 2 in order to effectively control payout of the rope 2. Thus, the tubes 5 may be glued, welded, snapped, or otherwise affixed into the bores 30. The tubes 5 may also be molded integral with the base 10. The preferred material for the tubes 5 is a lightweight, durable plastic such as is used for the container side wall 11. As illustrated in FIGS. 4 and 8, the tubes 5 are arranged in a radial pattern; however, other patterns may also be employed as will be detailed below.

Figure 2:
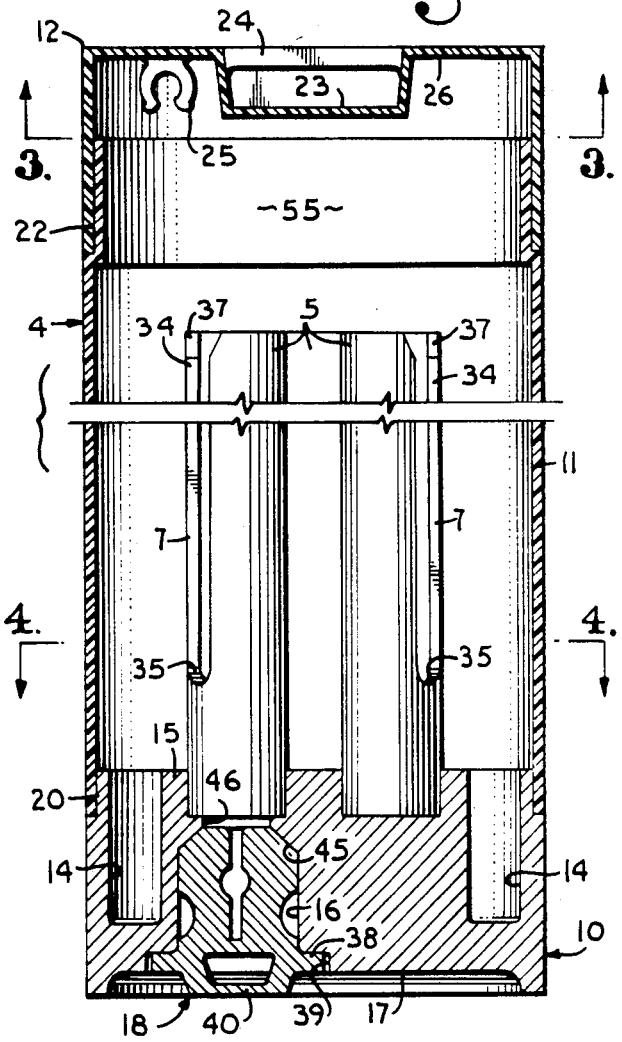
FIG. 2 is an enlarged axial cross sectional view of the container enclosing the escape rope apparatus with a knotted rope of the escape apparatus removed to show details of the container.
Figure 5:
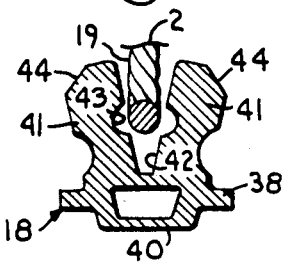
FIG. 5 is a sectional view of a plug member which provides access to a base end of a rope of the escape apparatus with clamp fingers of the plug shown in a released state.
Figure 3:
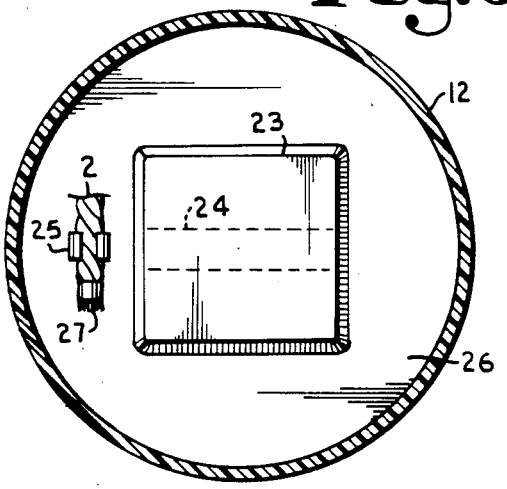
FIG. 3 is a transverse sectional view taken along line 3—3 of FIG. 2 and illustrates details inside the cap of the container.

Referring to FIGS. 2 and 7, the slots 7 are illustrated as formed in radially outward portions of the tube walls 32. The slots 7 have a width somewhat greater than the diameter of the rope 2 but considerably less than the diameter or thickness of a protuberance or knot 3, such that the knots 3 cannot easily slip through the slots 7. Each slot 7 has an open top portion 34 and a closed lower portion 35. The top portion 34 may be flared or beveled, as at 37, to facilitate placing the knots 3 in the tubes 5. The slots 7 have a length such that the distance between the top portion 34 of the slot 7 of one tube 5 to the lower portion 35 of the slot of the next tube in the packing order is approximately equal to a segment length 36 of the rope 2 which extends between two sequential knots 3. The purpose for spacing between the top portion 34 of one tube and the lower portion 35 of the next tube will be detailed below.

The base plug 18 provides quick access to the base end 19 of the rope 2. Referring to FIG. 2, the base plug 18 includes a plate portion 38 which fits into a counter bore 39 of the socket bore 16. On an external surface of the plug 18, a finger grip 40 is provided to facilitate removal of the plug 18 from the base 10 of the container 4. A rope groove 43 is formed in the surfaces of the fingers 41 within the slit 42 to receive the base end 19 of the rope 2.

The plug 18 is preferably formed of a hard resilient material, such as a hard rubber. The clamp fingers 41 are somewhat pliable for separation to receive the rope base end 19 and to remove same from the plug 18 when desired. The fingers 41 have frusto-conical surfaces 44 formed on the ends thereof which engage mating frusto-conical surfaces 45 formed at the inner end of the socket 16 when the plug 18 is placed in the socket 16. Engagement between these respective conical surfaces, as well as engagement between mutual cylindrical surfaces of the plug 18 and socket 16, prevents the clamp fingers 41 from being separated when the plug is in the socket, thereby preventing the rope base end 19 from being removed from the plug 18. Preferably, the base end 19 of the rope 2 is formed in a loop or eye to prevent the rope 2 from sliding lengthwise out of the groove 43 when the plug 18 is in the socket 16. The socket 16 is preferably aligned with one of the tubes 5 and communicates therewith through an aperture 46. The rope 2 extends from the aligned tube 47 through the aperture 46 and socket 16 for removable attachment to the base plug 18.

The rope 2 is the primary component of the escape apparatus 1. The essential characteristics of the rope 2 are tensile strength to safely support the weight of several average adults, a composition resistant to deterioration during storage, a thickness and texture for manual gripping which is not excessively fatiguing, and a length to permit escape from a reasonable height.

The rope 2 may be formed from natural fibers such as hemp, jute, sisal, or the like or from synthetic fibers such as Nylon or the like. There are trade-offs in advantages between the natural and synthetic fibers used in ropes. While superior natural fibers do not generally stretch and have a better feel for gripping, they are also subject to deterioration from the effects of moisture and aging. Synthetic fibers are not generally susceptible to weakening through rotting and are generally stronger per unit of diameter; however, they have a tendency to stretch under tension and are more difficult to grip because of a somewhat smoother feel. Cotton fiber ropes are generally not recommended because of their relative weakness compared to other natural fiber ropes. Wire ropes and chains are also not recommended because of the relative lack of flexibility of wire ropes and the high weight of wire ropes and chains which can be comfortably gripped. In general, natural fiber ropes, such as of hemp, are preferred in the present invention from a functional point of view. However, periodic inspection is recommended so that if deterioration occurs, the rope may be replaced to avoid reliance on a possibly defective rope.

The weight of the rope 2, and the apparatus 1, depends to a great extent on the length and diameter of the rope. The rope 2 should have a diameter of at least one half inch and not more three-quarters of an inch. This range provides a reasonable compromise between grippability and weight. The length of the rope 2 in the apparatus 1 depends on the height above ground at which the apparatus is to be used. A minimun length for the rope 2 might, for example, be about fifty feet which, when knotted, would be shortened to about thirtyseven feet. Such a length would allow a rescue descent of about three standard dwelling stories with some additional length for tying to an anchor structure.

The rope 2 may be increased in length, depending or the requirements, or could be tied onto a second rope 2 in a second apparatus 1 to increase the height from which descent may be made. It should be noted that the rope 2 need not necessarily extend all the way from the occupant's floor to the ground level. A successful rescue might be accomplished by descent to a raised fire rescue platform, a roof of an adjoining building, a balcony located below, or even a window located below the occupant for escape within the occupant's building. Attempted descents of greater than about sixty or seventy feet by those not experienced in rope climbing are not likely to be successful since gripping strength would likely be severely diminished before a safe release height were reached. However, even longer ropes 2 might be useful, such as by fire fighters, to carry to a floor above that which can be accessed by a rescue platform, to anchor and drop the apparatus to raise additional fire fighting equipment or rescue equipment. In such a situation, the advantage of reliable payout of the rope 2 packed according to the present invention would be present.

Figure 13:
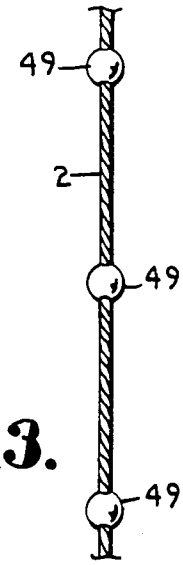
FIG. 13 is an elevational view at a reduced scale of a rope for the escape apparatus according to the present invention in which bead members are affixed along the rope to form grip enhancing protuberances.

The illustrated protuberances or knots 3 are simple overhand knots. Other types of knots are also contemplated, such as figure eight knots, and the like. Alternatively, large beads 49, see FIG. 13, which mechanically grip the rope 2 could be employed. The beads 49 have the advantage of not shortening the length of the rope 2 as knots 3 do. However, the use of knots 3 is more economical. The beads 49 are preferably formed from a lightweight plastic.

The protuberances 3 should be of a size that they enhance gripping by a person with average sized hands. Additional consideration should be given to the fact that the feet of the user would probably be coordinated with the hands in descending the rope 2. However, sharp edges should be avoid to reduce the chance of injury. The protuberances 3 should be spaced apart a segment length 36 in the range between about seven and twelve inches for rapid but controlled descent.

The rope 2 with knots or protuberances 3 is packed or arrayed within the container 4 by sequentially stacking the knots within the tubes 5 in an order from tube to tube. Referring to FIGS. 6–8, the tube 47 aligned with the base plug 18 is loaded first. As each knot 3 is placed in the tube, loops 6 between sequential knots extend through the slots 7. Care should be taken to insure that the loops 6 do not become entangled. When a selected number of knots 3 have been inserted into the aligned tybe 47, the next knot 3 is placed in an adjacent tube 5, either in a counterclockwise pattern as shown in FIG. 8, or in the opposite direction; and the process is repeated until all the tubes are filled or the rope 2 has been completely packed.

Between the top portion 34 of each slot 7 and the bottom portion 35 of the slot of the next tube in the packing order, an anchor segment 50 of the rope 2 extends to retain the stacks 51 of knots 3 within its respective tube 5 until the knots 3 of the adjacent tube have been payed out. The anchor segments 50 are tensioned somewhat to apply a force to the stack 51 of knots in the previous tube in the order of tubes 5. The rope 2 is payed out in a sequence opposite to the packing sequence. Thus, each stack 51 is retained in placed until released by the paying out of its anchor segment 50.

During packing, it is advisable to remove the side wall 11 for better access to the slots 7. After all the tubes 5 have been filled, the lower loops 6 of the rope 2 may be placed in the annular space 14 in the base 10 of the container 4. The side wall 11 is then installed, the cap end 27 of the rope is secured in the clip 25 in the cap 12, and the cap 12 is installed on the side wall 11.

In normal use, the cap 12 is removed, and the cap end 27 is retrieved from the cap 12 and tied to a substantial structure, such as a radiator, a heavy piece of furniture, or the like. A window is opened, and the packed container 4 is simply dropped toward the ground. The weight of the container 4 and the rope 2 still therein propels the container downward thereby causing the rope 2 to pay out sequentially. The knots 2 simply slide out of the last loaded tube 5 thereby releasing the stack 51 of knots 2 in the next tube, and so on. Friction between the rope 2 and the edges of the slots 7 slows the payout somewhat thereby controlling same. Since the only portion of the rope 2 which is released at any given moment is the trailing length upward, which is tensioned, the hazard of entanglement is greatly reduced.

FIG. 9 illustrates a drawstring net 54 which may be provided with the apparatus 1. The net 54 is stored in a flattened, undrawn, and folded condition in a space 55 at the upper end of the container 4. The net 54 is useful in the rescue of a small child or a pet which might be less than fully cooperative in an emergency situation. The net 54 is spread out flat, the child or pet placed thereon, and the drawstrings 56 drawn to enclose the child or pet therein. The net 54 may then by tied over the shoulder of an adult for descent on the rope 2. Alternatively, the base plug 18 may be withdrawn from the socket 16 to access the base end 19 of the rope and the drawstrings 56 tied thereto. Under such circumstances, the rope 2 must be payed out manually from the container 4 and then the net 54 lowered. No attempt should be made to let the rope pay out under the weight of the net with child or pet since the added weight would accelerate the payout process and probably seriously injure the child or pet.

Figure 10:
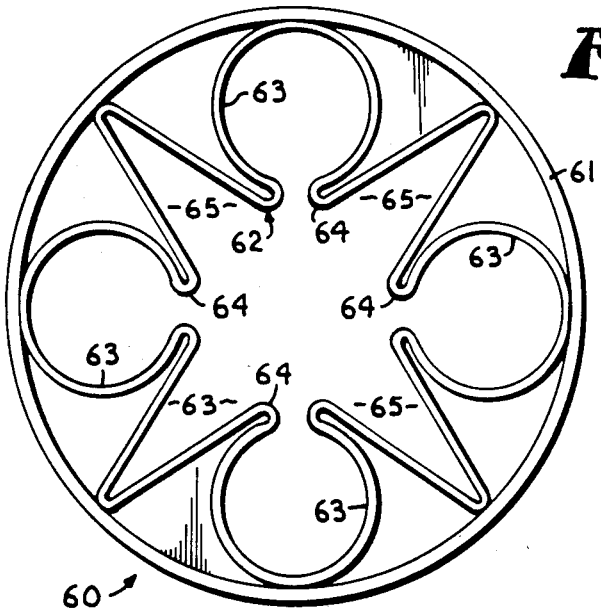
FIG. 10 is a top plan view of an alternative embodiment of the container of the escape apparatus with a cap removed to illustrate inwardly directed slots formed in knot receiving tubes thereof.

FIG. 10 illustrates a first alternative embodiment 60 of a container 61 and tube structure 62. The tube structure 62 may be integrally formed, as by extrustion. The tube structure 62 includes a plurality of integral tube members 63 having slots 64 extending therealong. In the tube structure 62 illustrated in FIG. 10, the slots 64 face radially inward. Because of this arrangement and the integral nature of the structure 62, loading is less convenient than with the apparatus 1. The structure 62 provides angled spaces 65 to receive the loops of rope (not shown) extending between protuberances on the rope to be loaded thereinto. The packing of a rope and the payout of the rope from the structure 62 are otherwise substantially similar to such corresponding processes in the apparatus 1.

Figure 11:
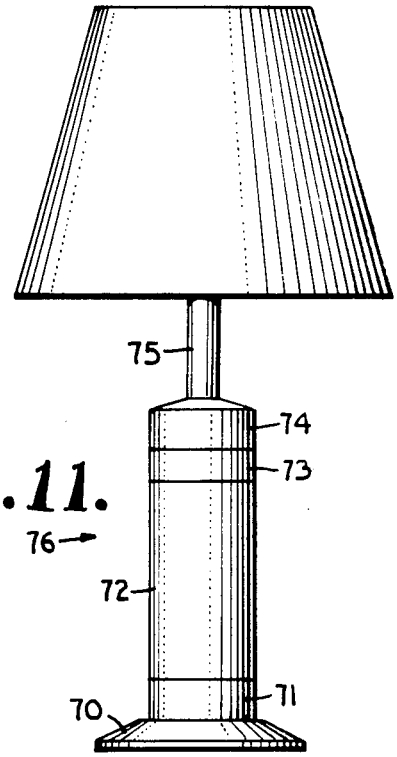
FIG. 11 is an elevational view at a reduced scale illustrating the adaptation of the container as a pedestal structure for a lamp.

FIG. 11 illustrates a manner of storing the packed escape rope apparatus according to the present invention. A foot structure 70 is adapted to receive the base 71 of a container 72, similar to the container 4 and housing an escape rope apparatus (not shown), to position the container 72 in an upright orientation. A cap 73 is adapted to receive a lamp base 74 of a lamp 75. The foot structure 70, container 72, and cap 73 form a lamp pedestal 76 to store the escape rope apparatus of the present invention in an unobtrusive manner at a handy location until use is needed.

Figure 12:
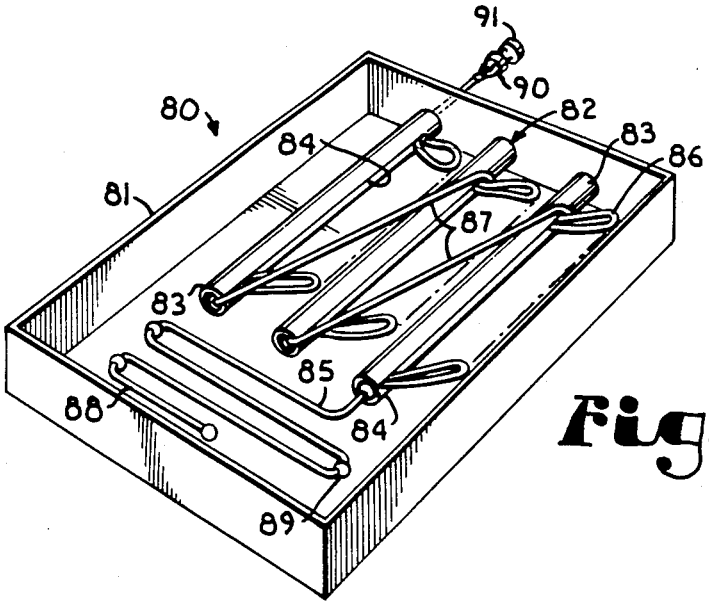
FIG. 12 is a perspective view at a reduced scale illustrating a second alternative embodiment of a container of the escape apparatus according to present invention in which the container is rectangular in form.

FIG. 12 illustrates a second alternative embodiment 80 of a container 81 and tube structure 82 according to the present invention. The container 81 is rectangular in form to be stored as in a suitcase (not shown). The tube structure 82 includes a plurality of tubes 83 having slots 84 formed therealong. A rope 85 of the apparatus 80 is arrayed within the container 81 in much the same manner as the rope 2 is arrayed within the tubes 5 of the container 4. The tubes 83 are positioned in a linear pattern in contrast to the radial pattern of the tubes 5. Protuberances (not shown) are received in the tubes 83 in stacks with loops 86 extending out of the tubes 83 through the slots 84. Anchor segments 87 of the rope 85 extend between the ends of adjacent tubes 83 to retain the stacks of protuberances within the tubes 83 until payout is desired. A head end 88 of the rope 85 is removably secured in clips 89 for quick access thereof. A base end 90 of the rope 85 is secured by a base plug 91 in a manner similar to the base plug 18. In operation and use, the apparatus 80 is substantially similar to the apparatus 1, differing principally in the shape of the container 81 and the placement pattern of the tubes 83.

It is to be understood that while certain forms of the present invention have been illustrated and described herein, it is not to be limited to the specific forms or arrangement of parts described and shown.

What is claimed and desired to secure by Letters Patent is as follows:

1. An emergency escape apparatus comprising:
(a) an elongated flexible line having opposite ends and a plurality of protuberances spaced therealong to form line segment lengths of said line between two sequential protuberances;
(b) an elongated protuberance receiving means, said protuberance receiving means having a wall;
(c) said wall having an elongated slot formed therein, said slot having an open end and an opposite closed end; and
(d) said protuberances being received sequentially within said protuberance receiving means through said open end of said slot from a first end of said line to an opposite free end of said line with each line segment length of said line forming a loop of line which extends outward from said protuberance receiving means through said slot when the pair of protuberances adjacent said segment length of line are positioned within said protuberance receiving means, such that said protuberances slide sequentially along said slot and out of said slot thereby paying out said line in an orderly manner upon said free end of said line being pulled.

2. An emergency escape apparatus comprising:
(a) an elongated flexible line having opposite ends and a plurality of protuberances spaced therealong;
(b) an elongated protuberance receiving tube, said tube having a tube wall;
(c) said tube having an elongated slot formed in said tube wall and extending along a substantial portion of the length of said tube, said slot having an open end and an opposite closed end; and
(d) said protuberances being received sequentially within said tube through said slot from a first end to an opposite free end of said line such that said protuberances slide sequentially along said slot and out of said tube thereby paying out said line in an orderly manner upon said free end of said line being pulled.

3. An apparatus as set forth in claim 2 including:
(a) a plurality of protuberance receiving tubes affixed together, each tube including an associated tube wall, each tube having an elongated slot formed in said wall along along a substantial portion of the length of the associated tube, each slot having an open end and an opposite closed end; and
(b) each tube sequentially receiving a plurality of said protuberances until filled, after which a next adjacent tube sequentially receives a plurality of said protuberances.

4. An apparatus as set forth in claim 2 including;
(a) a plurality of protuberance receiving tubes affixed together, each tube including an associated tube wall, each tube having an elongated slot formed in said wall along a substantial portion of the length of the associated tube, each slot having an open end and an opposite closed end;
(b) each tube having a length to receive a selected number of said protuberances;
(c) a distance from the open end of the slot of a tube to the closed end of the slot of an adjacent tube being substantially equal to a segment length of said line between two sequential protuberances; and
(d) each tube, in an order from a first tube to a last tube of said plurality of tubes, sequentially receiving said selected number of protuberances with an anchor segment of said line extending between the open end of the slot of one tube to the closed end of the slot of a next tube such that tension in said anchor segment exerts a force on a stack of protuberances in said one tube to retain said protuberances therein.

5. An apparatus as set forth in claim 2 including:
(a) a container having said tube and said line enclosed therein.

6. An apparatus as set forth in claim 2 including:
(a) a container including a tubular container wall with opposite ends;
(b) a cap closing a cap end of said container;
(c) a base closing a base end of said container; and
(d) said protuberance receiving tube being positioned within said container and said line being arrayed within said container in cooperation with said tube.

7. An apparatus as set forth in claim 6 wherein:
(a) said cap includes cap line retainer means removably retaining a cap end of said line to facilitate the location of the line cap end during use of said apparatus.

8. An apparatus as set forth in claim 6 wherein:
(a) said base includes base line retainer means removably retaining a base end of said line to facilitate the location of the line base end during use of said apparatus.

9. An apparatus as set forth in claim 8 wherein said base line retainer means includes:
(a) a base line retainer plug received in said base external to said container, said plug being removable to provide external access to said line base end.

10. An apparatus as set forth in claim 6 including:
(a) a base retainer plug received in said base end external to said container, said plug being removable to provide external access to a base end of said line; and
(b) said plug including a pair of opposed clamp fingers resiliently urged into removable clamping engagement with the line base end such that upon said plug being removed from said base, said line base end withdrawn therewith.

11. An apparatus as set forth in claim 10 including:

(a) a socket formed on an external surface of said base end to receive said plug, said socket having an open end and an opposite end face;

(b) said socket having angled abutment surfaces formed adjacent said end face; and (c) said clamp fingers having angled clamp abutment surfaces which cooperatively engage the socked abutment surfaces upon said plug being positioned within said socket thereby urging said clamp fingers into clamping engagement with said line base end such that the removal of said line base end from said fingers is prevented when said plug is positioned within said socket.

12. An apparatus as set forth in claim 6 wherein:

(a) said container forms a pedestal structure for a lamp.

13. An emergency escape apparatus comprising:

(a) an elongated flexible line having opposite ends and a plurality of protuberances spaced therealong to form line segment lengths of said line between two sequential protuberances;

(b) an elongated protuberance receiving tube, said tube having a tube wall;

(c) said tube having an elongated slot formed in said tube wall and extending along a substantial portion of the length of said tube, said slot having an open end and an opposite closed end;

(d) said protuberances being received sequentially within said tube through said slot from a first end to an opposite free end of said line such that said protuberances slide sequentially along said slot and out of said tube thereby paying out said line in an orderly manner upon said free end of said line being pulled;

(e) a container including a tubular container wall with opposite ends;

(f) a cap closing a cap end of said container;

(g) a base closing a base end of said container;

(h) said protuberance receiving tube being positioned within said container and said line being arrayed within said container in cooperation with said tube;

(i) said cap including cap line retainer means removably retaining a cap end of said line to facilitate the location of the line cap end during use of said apparatus; and (j) said base including base line retainer means removably retaining a base end of said line to facilitate the location of the line base end during use of said apparatus.

14. An apparatus as set forth in claim 13 including:

(a) a plurality of protuberance receiving tubes positioned within said container, each tube including an associated tube wall, each tube having an elongated slot formed in said wall along along a substantial portion of the length of the associated tube, each slot having an open end and an opposite closed end; and (b) each tube sequentially receiving a plurality of said protuberances until filled, after which a next adjacent tube sequentially receives a plurality of said protuberances.

15. An apparatus as set forth in claim 13 including;

(a) a plurality of protuberance receiving tubes positioned within said container, each tube including an associated tube wall, each tube having an elongated slot formed in said wall along a substantial portion of the length of the associated tube, each slot having an open end and an opposite closed end;

(b) each tube having a length to receive a selected number of said protuberances;

(c) a distance from the open end of the slot of a tube to the closed end of the slot of an adjacent tube being substantially equal to said segment length of said line; and (d) each tube, in an order from a first tube to a last tube of said plurality of tubes, sequentially receiving said selected number of protuberances with an anchor segment of said line extending between the open end of the slot of one tube to the closed end of the slot of a next tube such that tension in said anchor segment exerts a force on a stack of protuberances in said one tube to retain said protuberances therein.

16. An apparatus as set forth in claim 13 wherein said base line retainer means includes:

(a) a base line retainer plug received in said base external to said container, said plug being removable to provide external access to said line base end.

17. An apparatus as set forth in claim 13 including:

(a) a base retainer plug received in said base end external to said container, said plug being removable to provide external access to a base end of said line; and (b) said plug including a pair of opposed clamp fingers resiliently urged into removable clamping engagement with the line base end such that upon said plug being removed from said base, said line base end withdrawn therewith.

18. An apparatus as set forth in claim 13 including:

(a) a socket formed on an external surface of said base end to receive said plug, said socket having an open end and an opposite end face;

(b) said socket having angled abutment surfaces formed adjacent said end face; and (c) said clamp fingers having angled clamp abutment surfaces which cooperatively engage the socked abutment surfaces upon said plug being positioned within said socket thereby urging said clamp fingers into clamping engagement with said line base end such that the removal of said line base end from said fingers is prevented when said plug is positioned within said socket.

19. An apparatus as set forth in claim 13 including:

(a) undrawn drawstring net means stored in said container, said net means including a drawstring operable to close said net means to thereby enclose a small child or pet within said net means.

20. An apparatus as set forth in claim 13 wherein:

(a) said container is elongated;

(b) said base includes foot means to position said container in an upstanding orientation; and (c) said cap is configured to receive a base of a lamp thereon such that said container forms a pedestal structure for a lamp.

21. An emergency escape apparatus comprising:

(a) an elongated flexible line having opposite ends and a plurality of protuberances spaced therealong to form line segment lengths of said line between two sequential protuberances;

(b) a container including a tubular container wall with opposite ends;

(c) a cap closing a cap end of said container;

(d) a base closing a base end of said container;

(e) said cap including cap line retainer means removably retaining a cap end of said line to facilitate the location of the line cap end during use of said apparatus;

(f) said base including base line retainer means removably retaining a base end of said line to facilitate the location of the line base end during use of said apparatus;

(g) a plurality of protuberance receiving tubes positioned within said container, each tube including an associated tube wall, each tube having an elongated slot formed in said wall along a substantial portion of the length of the associated tube, each slot having an open end and an opposite closed end;

(h) each tube having a length to receive a selected number of said protuberances;

(i) a distance from the open end of the slot of a tube to the closed end of the slot of an adjacent tube being substantially equal to said segment length of said line;

(j) in an order from a first tube to a last tube of said plurality of tubes, each tube sequentially receiving said selected number of protuberances through its associated slot from a first end to an opposite free end of said line to array said line within said container such that said protuberances slide sequentially along said slot and out of said tube thereby paying out said line in an orderly manner upon said free end of said line being pulled;

(k) an anchor segment of said line extending between the open end of the slot of one tube to the closed end of the slot of a next tube such that tension in said anchor segment exerts a force on a stack of protuberances in said one tube to retain said protuberances therein.

22. An apparatus as set forth in claim 21 including:

(a) a socket formed on an external surface of said base end, said socket having an open end and an opposite end face;

(b) said socket having angled abutment surfaces formed adjacent said end face;

(c) a base retainer plug received in said socket, said plug being removable to provide external access to a base end of said line;

(d) said plug including a pair of opposed clamp fingers resiliently urged into removable clamping engagement with the line base end such that upon said plug being removed from said base, said line base end withdrawn therewith; and (e) said clamp fingers having angled clamp abutment surfaces which cooperatively engage the socked abutment surfaces upon said plug being positioned within said socket thereb further urging said clamp fingers into clamping engagement with said line base end such that the removal of said line base end from said fingers is prevented when said plug is positioned within said socket.

23. An apparatus as set forth in claim 21 including:

(a) undrawn drawstring net means stored in said container, said net means including a drawstring operable to close said net means to thereby enclose a small child or pet within said net means.

* * * * *